US009360837B2

(12) United States Patent
Hirasawa et al.

(10) Patent No.: US 9,360,837 B2
(45) Date of Patent: Jun. 7, 2016

(54) AIR-CONDITIONING UNIT, IMAGE FORMING APPARATUS INCORPORATING SAME, AND AIR-CONDITIONING CHANNEL SWITCHING METHOD

(71) Applicants: Tomoyasu Hirasawa, Kanagawa (JP); Kenichi Takehara, Kanagawa (JP); Hiromitsu Fujiya, Kanagawa (JP); Keisuke Yuasa, Kanagawa (JP); Yasuaki Toda, Kanagawa (JP); Keisuke Ikeda, Kanagawa (JP)

(72) Inventors: Tomoyasu Hirasawa, Kanagawa (JP); Kenichi Takehara, Kanagawa (JP); Hiromitsu Fujiya, Kanagawa (JP); Keisuke Yuasa, Kanagawa (JP); Yasuaki Toda, Kanagawa (JP); Keisuke Ikeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/024,933

(22) Filed: Sep. 12, 2013

(65) Prior Publication Data

US 2014/0093269 A1 Apr. 3, 2014

(30) Foreign Application Priority Data

Oct. 3, 2012 (JP) ..... 2012-221370

(51) Int. Cl.

| | |
|---|---|
| ***G03G 21/20*** | (2006.01) |
| ***F24F 13/00*** | (2006.01) |
| ***F24F 11/00*** | (2006.01) |

(52) U.S. Cl.

CPC ..... *G03G 21/206* (2013.01); *F24F 11/006* (2013.01); *F24F 13/00* (2013.01); *F24F 2011/0006* (2013.01); *F24F 2011/0064* (2013.01); *F24F 2011/0075* (2013.01); *G03G 2221/1645* (2013.01)

(58) Field of Classification Search

CPC ..... G03G 21/206; G03G 2221/1645
USPC ..... 399/92, 94
See application file for complete search history.

(56) References Cited

U.S. PATENT DOCUMENTS

| | | | | |
|---|---|---|---|---|
| 4,324,286 | A * | 4/1982 | Brett | B60H 1/00371 165/202 |
| 4,401,149 | A * | 8/1983 | Iijima | B60H 1/00835 165/122 |
| 5,657,639 | A * | 8/1997 | Lidbeck | F25D 17/045 62/186 |
| 5,819,137 | A * | 10/1998 | Hoffman et al. | 399/93 |
| 6,621,554 | B1 * | 9/2003 | Ayash et al. | 355/30 |
| 6,711,470 | B1 * | 3/2004 | Hartenstein et al. | 700/276 |
| 7,460,809 | B2 * | 12/2008 | Shirakata et al. | 399/92 |
| 2003/0086722 | A1 | 5/2003 | Nakazato et al. | |
| 2011/0172831 | A1 * | 7/2011 | Kreft et al. | 700/278 |

FOREIGN PATENT DOCUMENTS

| | | |
|---|---|---|
| JP | 2003-122208 | 4/2003 |
| JP | 2003-280472 | 10/2003 |
| JP | 2006-110743 | 4/2006 |
| JP | 2012-048160 | 3/2012 |
| JP | 2012-073596 | 4/2012 |
| JP | 2012-145820 | 8/2012 |

* cited by examiner

*Primary Examiner* — Benjamin Schmitt
(74) *Attorney, Agent, or Firm* — Oblon, McClelland, Maier & Neustadt, L.L.P.

(57) ABSTRACT

An air-conditioning unit includes an air conditioner to control air temperature, a first channel to guide air supplied from the air conditioner to a conditioning target, a heat exchange channel through which the air supplied from the air conditioner exchanges heat with the conditioning target, a second channel to guide air from the conditioning target either outside the air-conditioning unit or to the air conditioner, and a channel switching unit to cause the air conditioner to suck in either external air or the air guided from the conditioning target.

17 Claims, 9 Drawing Sheets

AIR-CONDITIONING UNIT, IMAGE FORMING APPARATUS INCORPORATING SAME, AND AIR-CONDITIONING CHANNEL SWITCHING METHOD

CROSS-REFERENCE TO RELATED APPLICATION

This patent application is based on and claims priority pursuant to 35 U.S.C. §119 to Japanese Patent Application No. 2012-221370, filed on Oct. 3, 2012, in the Japan Patent Office, the entire disclosure of which is hereby incorporated by reference herein.

BACKGROUND OF THE INVENTION

1. Technical Field

The present invention generally relates to an air-conditioning unit, an image forming apparatus, such as, a copier, a printer, a facsimile machine, a plotter, or a multifunction peripheral (MFP) having at least two of coping, printing, facsimile transmission, plotting, and scanning capabilities, that incorporates an air conditioner, and a method of switching an airflow channel; and more particularly, to an air-conditioning unit to adjust temperature at a specific position inside an apparatus, an image forming apparatus including the air-conditioning unit, and a method of switching an air-conditioning channel therein.

2. Description of the Background Art

Image forming apparatuses, such as printers, facsimile machines, copiers, and digital multifunction machines generally record images constituted of characters, symbols, illustrating, or combinations thereof on sheets of recording media, such as paper, overhead projector (OHP) film, and the like, according to image data. Among various types of image forming apparatuses, electrophotographic image forming apparatuses can print high-resolution images on plain paper at high speed and are widely used.

Image forming components inside electrophotographic image forming apparatuses are susceptible to environmental changes. In particular, properties thereof can change depending on temperature and humidity.

Typically, image forming apparatuses include multiple heat generators such as an optical writing device, a fixing device, a developing device, and driving motors to rotate a photoreceptor and the like. Thus, temperature can increase at various positions inside the apparatus.

Therefore, there are image forming apparatuses that include an air conditioner. FIGS. 12A and 12B illustrate a configuration and an operational theory of a typical air conditioner, a vapor-compression refrigerator.

The vapor-compression refrigerator shown in FIG. 12A includes a compressor 101 to compress coolant, a first heat exchanger (condenser) 102 to exchange heat between coolant and air, a second heat exchanger (evaporator) 103, an expansion valve 104 to depressurize coolant, and a four-way valve 105 to switch the route of coolant between multiple channels. The vapor-compression refrigerator can heat and cool air by repeating the following cycle.

1. Compression: Compress low-pressure and low-temperature vapor of coolant by the compressor 101 into high-pressure and high-temperature valor of coolant.

2. Condensation: Send the coolant vapor compressed by the compressor 101 to the first heat exchanger 102 and cool the coolant vapor with air into liquid (liquid coolant). At that time, air is heated.

3. Expansion: Depressurize the high-pressure liquid coolant liquefied by the first heat exchanger 102 by the expansion valve 104.

4. Evaporation: Cause the liquid coolant depressurized by the expansion valve 104 to evaporate using the second heat exchanger 103, and draw heat from the air. Thus, the air is cooled.

FIG. 12C is a temperature entropy diagram or T-S diagram illustrating the above-described processes.

The compressor 101 compresses dry saturated vapor A of coolant to a pressure higher than the saturated vapor pressure at a predetermined temperature in the first heat exchanger 102, thus creating superheated saturated vapor B. The superheated saturated vapor B is then sent to the first heat exchanger 102. In the first heat exchanger 102, heat is exchanged between the superheated saturated vapor B and air. Heat Q1 is drawn out from the superheated saturated vapor B, and the superheated saturated vapor B is cooled and liquefied into saturated liquid C. The saturated liquid C is sent to the expansion valve 104, and isenthalpic expansion is executed by the expansion valve 104. Thus, the saturated liquid C becomes wet vapor D and is sent to the second heat exchanger 103. The wet vapor D draws in heat or heat amount Q2 from air and vaporizes, thus returning to the dry saturated vapor A.

FIG. 12B illustrates a state in which the orientation of the four-way valve 105 is switched from that shown in FIG. 12A. More specifically, in FIG. 12A, the channel of coolant starting from the compressor 101 extends to the first heat exchanger 102, the expansion valve 104, and the second heat exchanger 103 in that order. By switching the channel of coolant shown in FIG. 12A from the compressor 101 to the second heat exchanger 103, the expansion valve 104, and the first heat exchanger 102 as shown in FIG. 12B, functions of the first and second heat exchangers 102 and 103 can be switched between a condenser and an evaporator; and an evaporator and a condenser.

However, the volume of air conditioning target can be large when air in the entire image forming apparatus is conditioned by the above-described air conditioner, resulting in increases in cost, size of the apparatus, noise, and power consumption in accordance with the control capacity. Therefore, when an air conditioner is employed in an image forming apparatus, typically power consumption is greater compared with a configuration employing a cooling fan.

Therefore, air conditioning may be performed in or around only an image forming unit including a photoreceptor, a developing device, and the like.

For example, JP-2003-122208-A proposes the following configuration to efficiently remove substances hazardous to image formation from the surroundings of the photoreceptor. The configuration includes a body case, an image forming unit including an image forming case housing at least the photoreceptor and, and an air-conditioning means to remove the hazardous substances, which flows in the image forming unit from outside. The photoreceptor is partly exposed from an opening for transfer formed in the image forming unit. The opening for transfer is the only opening from which the hazardous substances may flow in the image forming unit in the state in which the image forming unit is attached to the body case.

The air-conditioning means is disposed on the entrance side of a flow channel extending from the outside of the image forming unit via the image forming unit to the outside. Further, the air-conditioning means is positioned midway in a circulation channel through which air flows in the image forming unit after discharged from the image forming unit to the outside.

Additionally, JP-3924484-B (JP-2003-280472-A) proposes a configuration to maintain satisfactory performance of a cleaning blade to scrape off residual toner from the photoreceptor even in the case where temperature and humidity around the electrophotographic image forming apparatus change. The apparatus includes a temperature adjusting device having heating capability to supply heated air and cooling capability to supply cooled air, an air-conditioning means to adjust temperature of the cleaning blade, a temperature sensor to measure temperature of the cleaning blade, and a temperature control means to drive the air-conditioning means to set the temperature of the cleaning blade at a temperature suitable to scrape off residual toner according to detection of the temperature sensor and a preset reference temperature. This image forming apparatus includes multiple image forming modules to form different color images, and each image forming module includes at least the photoreceptor, the developing unit, and the cleaning unit housed in a common case. Each case defines a substantially closed space in which temperature is controlled by the air-conditioning means, and the preset reference temperature is set for each of the multiple image forming modules.

JP-3924484-B (JP-2003-280472-A) further proposes a configuration that employs a humidity controlling means, instead of or in addition to the temperature adjusting device, and a reference humidity is set instead of the reference temperature.

There are two air-conditioning types to control temperature and humidity inside image forming apparatuses (apparatus bodies, in particular). In one type of air conditioning, airflow generated by the air conditioner (hereinafter also "conditioning airflow" or "flow of conditioning air") is supplied to a conditioning target inside the apparatus body and then is again sucked in by the air conditioner (hereinafter "circulation type"). In another type of air conditioning, the airflow generated by the air conditioner is supplied to the conditioning target inside the apparatus body and exhausted outside the image forming apparatus. The air conditioner sucks in fresh external air outside the image forming apparatus (hereinafter "intake and exhaust type"). To keep the conditioning target at a target temperature, in either of the above-described air-conditioning types, flow of conditioned air at a predetermined temperature is generated, and the predetermined temperature is set according to the target temperature.

When the environmental temperature outside the apparatus body is higher than that of the conditioning airflow, temperature of the airflow that has passed through the conditioning target may be lower than the temperature outside the apparatus body. Under such conditions, the airflow at the predetermined temperature can be generated with a smaller amount of energy in the circulation type air conditioning since the temperature of air sucked in by the air conditioner is lower compared with the intake and exhaust type.

By contrast, when the temperature outside the apparatus body is lower than that of the conditioning airflow, temperature of the airflow that has passed through the conditioning target may be higher than the temperature outside the apparatus body. Under such conditions, the airflow at the predetermined temperature can be generated with a smaller amount of energy in the intake and exhaust type air conditioning since the temperature of air sucked in by the air conditioner is lower compared with the circulation type.

Thus, from the viewpoint of energy consumption, in some cases, one of the circulation type and the intake and exhaust type is advantageous over the other depending on the temperature outside the apparatus body.

In view of the foregoing, the inventors of the present invention recognize there is a need for generating air conditioning airflow in an energy-efficient method regardless of the temperature outside the apparatus body.

SUMMARY OF THE INVENTION

In view of the foregoing, one embodiment of the present invention provides an air-conditioning unit includes an air conditioner to control air temperature, a first channel to guide air supplied from the air conditioner to a conditioning target, a heat exchange channel through which the air supplied from the air conditioner exchanges heat with the conditioning target, a second channel to guide air from the conditioning target either outside the air-conditioning unit or to the air conditioner, and a channel switching unit to cause the air conditioner to suck in either external air or the air guided from the conditioning target.

In another embodiment, the above-described air-conditioning unit is incorporated in an image forming apparatus.

Yet another embodiment provides a method of switching an air-conditioning channel in the above-described air-conditioning unit. The method includes a step of comparing temperature of air in the second channel and external air temperature; and a step of switching, according to a result of the comparing, an air-conditioning channel between a circulating route to circulate air inside the air-conditioning unit and an external-air intake route to exhaust air outside and to introduce external air into the air-conditioning unit.

To cool the conditioning target, the channel switching unit switches the air-conditioning channel to the external-air intake route when the external air temperature is lower than the temperature of air in the second channel, and the channel switching unit switches the air-conditioning channel to the circulating route when the external air temperature is higher than the temperature of air in the second channel. To heat the conditioning target, the channel switching unit switches the air-conditioning channel to the external-air intake route when the external air temperature is higher than the temperature of air in the second channel, and the channel switching unit switches the air-conditioning channel to the circulating route when the external air temperature is lower than the temperature of air in the second channel.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
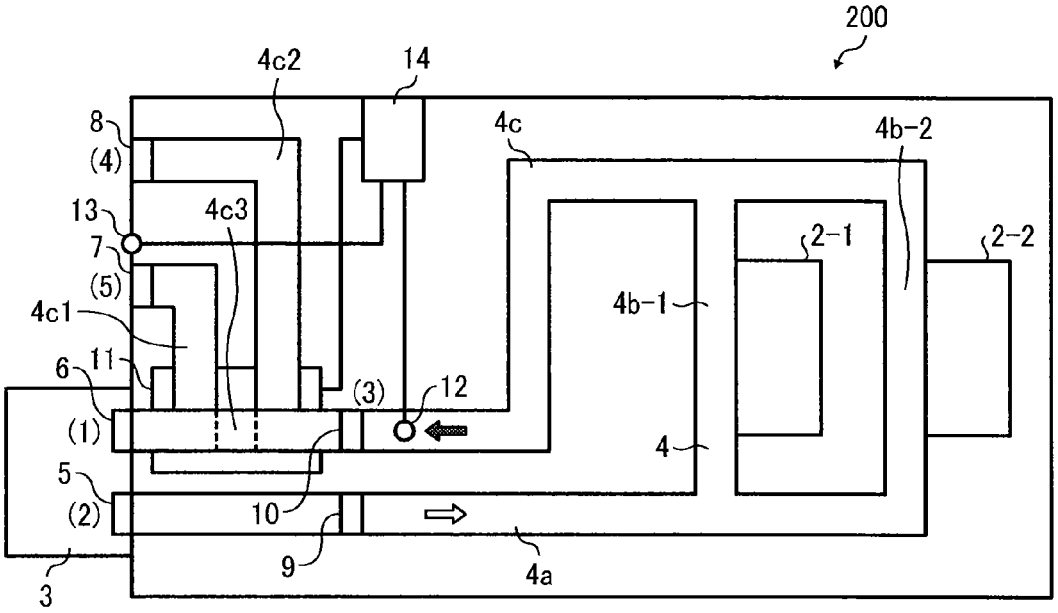
FIGS. 1A and 1B are schematic front views of an image forming apparatus according to a first embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

According to an aspect of this specification, temperature of air outside an image forming apparatus and that of airflow in an air-conditioning channel inside the apparatus is compared, and air to be sucked in by an air conditioner is switched between the two based on the results.

Figure 11:
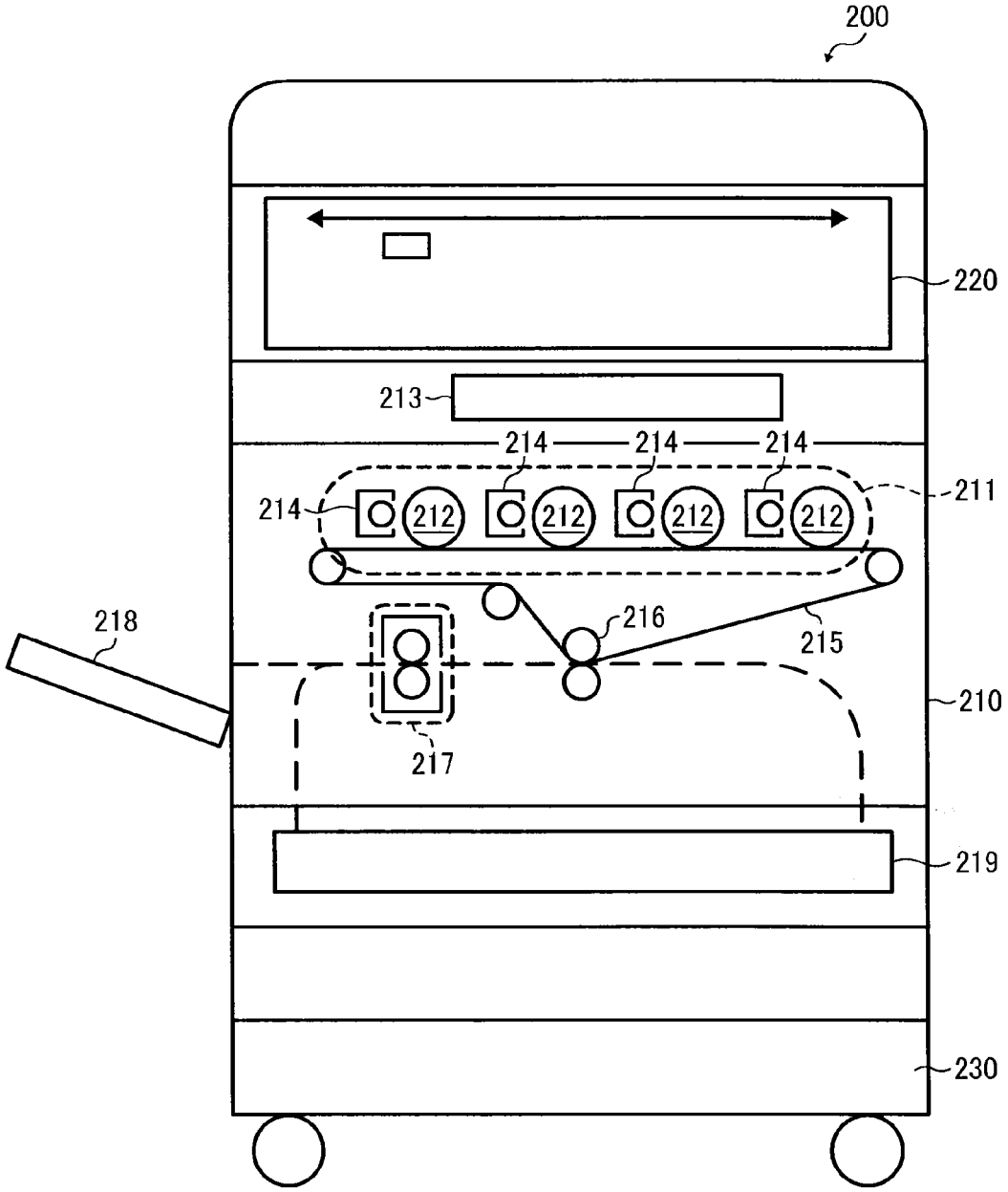
FIG. 11 illustrates a configuration of an image forming apparatus schematically.
Figure 12A:
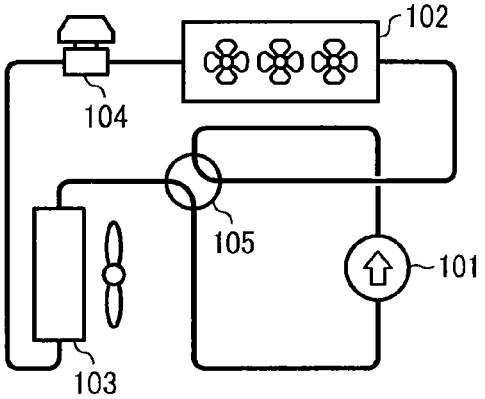
FIG. 12A RELATED ART
FIGS. 12A and 12B illustrate a configuration and an operational theory of a vapor-compression refrigerator as a typical air conditioner.
Figure 12B:
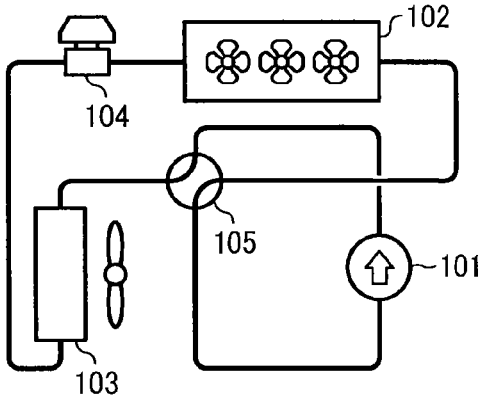
FIG. 12B RELATED ART
Figure 12C:
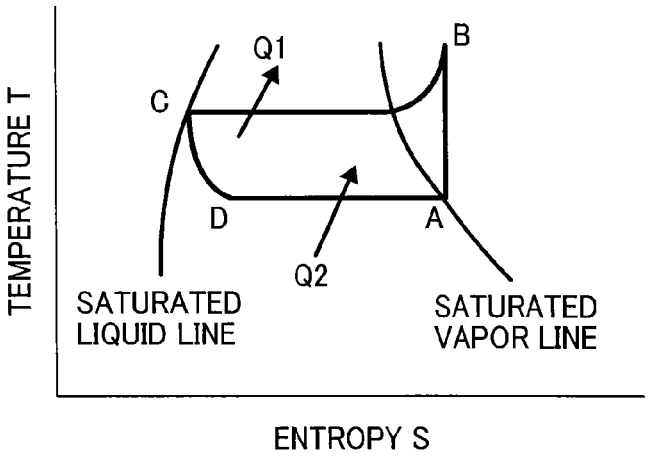
FIG. 12C RELATED ART
FIG. 12C is a temperature entropy diagram (T-S diagram).

Referring now to the drawings, wherein like reference numerals designate identical or corresponding parts throughout the several views thereof, and particularly to FIG. 11, a schematic configuration and operation of a multicolor image forming apparatus is described.

FIG. 11 illustrates a configuration of an image forming apparatus schematically.

An image forming apparatus 200 illustrated in FIG. 11 is an electrophotographic multicolor image forming apparatus employing indirect or intermediate image transfer and configured to superimpose different color images one on another on an intermediate transfer member. Since image forming apparatuses of this type are known, configuration and operation thereof are described schematically.

In FIG. 11, the image forming apparatus 200 includes an apparatus body 210, an image reading device 220, and a sheet feeder 230. The apparatus body 210 houses a tandem image forming unit 211 including four photoreceptors 212. A writing device 213 directs laser beams to the respective photoreceptors 212 according to image data read by the image reading device 220, thereby forming electrostatic latent images thereon. The photoreceptors 212 can be drum-shaped.

The tandem image forming unit 211 includes developing devices 214 to cause toner included in developer to adhere to the respective photoreceptors 212, thereby forming yellow, cyan, magenta, and black images, respectively. The toner images are sequentially transferred onto an intermediate transfer belt 215. Then, a secondary-transfer device 216 transfers the toner image from the intermediate transfer belt 215 onto a sheet (i.e., a transfer sheet or recording media sheet) transported from the sheet feeder 230. A fixing device 217 applies heat and pressure to the sheet bearing the image to fuse and fix toner on the sheet.

In simplex printing, the sheet is then discharged to a discharge sheet tray 218. In duplex printing, the sheet is reversed upside down in a reversal unit 219 and transported again to the secondary-transfer device 216. The tandem image forming unit 211 forms a subsequent image by repeating the above-described processes. Then, the image is transferred onto the other side (i.e., back side) of the sheet and fixed thereon, after which the sheet is discharged to the discharge sheet tray 218.

In the image forming apparatus 200, the writing device 213, the fixing device 217, the developing devices 214, a driving motor to rotate the photoreceptors 212, and the like generate heat, thus raising temperature at various positions inside the apparatus.

For example, in the developing device 214, heat is generated by sliding contact between developer and developer conveyance members to transport the developer as well as contact among developer particles, and temperature inside the developing device 214 tends to rise.

Additionally, a developer regulator adjusts the layer thickness of developer carried on the developer bearer (i.e., a developing roller) before developer is transported to a development range. The temperature inside the developing device 214 can rise also due to sliding contact between developer and the developer regulator and contact among developer particles being regulated by the developer regulator.

When the temperature inside the developing device 214 rises beyond a certain point, the amount of charge of toner can decrease, making it difficult to attain desired image density. Moreover, the temperature rise can fuse toner and cause the toner to coagulate. Then toner can firmly adhere to the developer regulator, the developer bearer, and the photoreceptor 212, resulting in substandard images that include unintended lines or the like. In particular, the possibility of image failure caused by coagulation or solidification of toner is higher when toner of a lower fusing temperature is used to reduce energy for image fixing.

Further, charged particles such as toner and carrier as well as the charged photoreceptors 212 are used in image formation by the image forming apparatus 200. Accordingly, when the charged states of such elements change, affected by composition of air, humidity in particular, inside the image forming apparatus 200, image quality becomes unstable. For example, charged particles such as toner and carrier used in electrophotographic apparatuses are designed such that their electrostatic charge state becomes stable by adding a charge controller to polymeric resin. Even if polymeric resin is treated to make it hydrophobic, the polymeric resin draws moisture from air due to its electrical characteristics. Thus, changes are caused in the electrical resistance, the friction coefficient among powders, or the fluidity. As a result, the charge amount of toner inside the developing device 214 decreases, thus causing image quality to fluctuate. For example, image density can increase.

In charging devices using electrical discharge, nitric acid compounds are produced by electrical discharge. When nitric acid compounds are combined with moisture in air, ionic substances such as nitric acid and nitrate adhere to the surface of the photoreceptor 212. Such adhering substances accelerate wear of the surface of the photoreceptor 212 and can result in abnormal wear thereof. Further, when the surface is made conductive by the ionic substances, electrostatic latent images are blurred or faded, causing image failure called image deletion.

In view of the foregoing, the image forming apparatus 200 is provided with an air conditioner.

(First Embodiment)

An air-conditioning structure of the image forming apparatus 200 according to a first embodiment is described below.

Figure 1B:
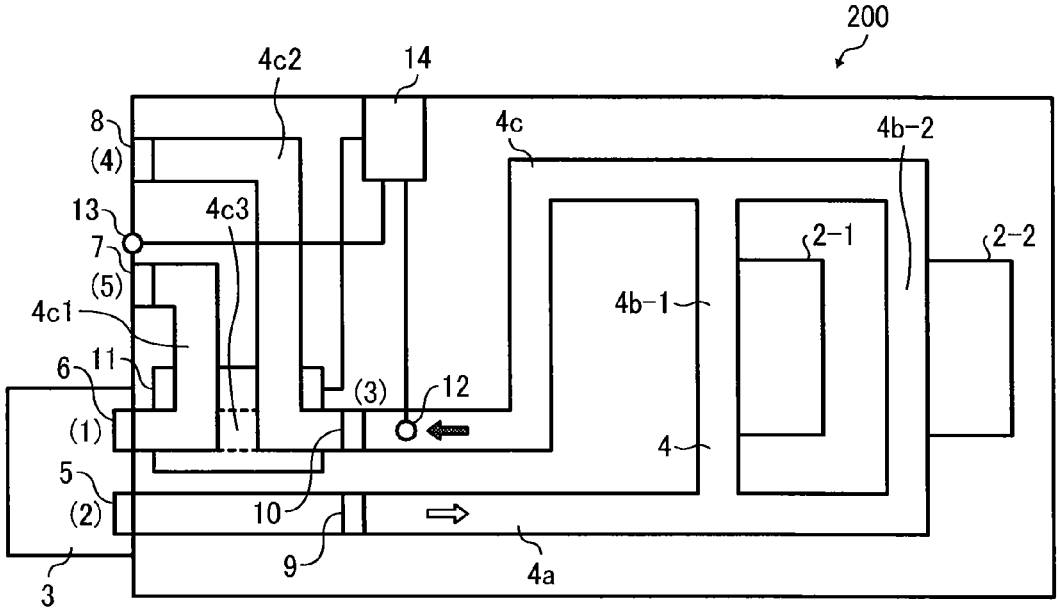

FIGS. 1A and 1B are schematic front views that illustrate the air-conditioning structure of the image forming apparatus 200 according to the first embodiment.

In the configuration shown in FIGS. 1A and 1B, the image forming apparatus 200 includes two targets where temperature control (i.e., environmental conditioning) is performed, namely, first and second conditioning targets 2-1 and 2-2. It is to be noted that, although descriptions given below are based on the premise that the number of the conditioning targets is two, the number of the conditioning targets is not limited thereto. The first and second conditioning target 2-1 and 2-2 are also referred to as conditioning targets 2 collectively.

The image forming apparatus 200 includes an air conditioner 3, an air-conditioning channel 4 constructed of, for example, an air duct, an air supply port 5, an air suction port 6, first and second external vents 7 and 8, first and second openings 9 and 10, an channel switching section 11, a temperature sensor 12, an ambient temperature sensor 13, and a switching controller 14. The channel switching section 11 and the switching controller 14 together form a channel switching unit.

The air supply port 5 and the air suction port 6 are positioned at the ends of the air-conditioning channel 4 connected to the air conditioner 3. The air conditioner 3 supplies air from the air supply port 5 to the apparatus body and draws in air from the air suction port 6. The air-conditioning channel 4 includes a forward channel 4*a* to send air toward the first and second conditioning targets 2-1 and 2-2, heat exchange channels 4*b*-1 and 4*b*-2 for heat exchange, and a return channel 4*c* through which air flows from the first and second conditioning targets 2-1 and 2-2 to the air conditioner 3. In the airflow direction, the air supply port 5 is situated at the upstream end of the forward channel 4*a*, and the air suction port 6 is situated at the downstream end of the return channel 4*c*. The heat exchange channels 4*b*-1 and 4*b*-2 are also referred to as heat exchange channels 4*b* collectively. A first bifurcation channel 4*c*1 bifurcates from the return channel 4*c* and communicates with the first external vent 7, that is, opens to the outside. A second bifurcation channel 4*c*2 bifurcates from the return channel 4*c* and communicates with the second external vent 8, that is, opens to the outside.

Using the channel switching section 11, the state of the return channel 4*c* is switched between to a circulating route shown in FIG. 1A, in which the third communication channel 4*c*3 communicating with the air suction port 6 is used, and an external-air intake route shown in FIG. 1B, in which the first bifurcation channel 4*c*1 communicating with the first external vent 7 and the second bifurcation channel 4*c*2 communicating with the second external vent 8 are used. In the present embodiment, circulation type air conditioning in which external air is not used is performed in the state shown in FIG. 1A. In the state shown in FIG. 1B, external air is introduced through the external-air intake route, and intake and exhaust type air conditioning is performed.

One end (i.e., a first end) of each of the first and second bifurcation channels 4*c*1 and 4*c*2 respectively communicates with the first and second external vents 7 and 8 and is open to the outside. The other end (i.e., a second end) of each of the first and second bifurcation channels 4*c*1 and 4*c*2 communicates with the return channel 4*c*. The third communication channel 4*c*3 is formed between a first connection where the return channel 4*c* is connected to the first bifurcation channel 4*c*1 and a second connection where the return channel 4*c* is connected to the second bifurcation channel 4*c*2. When the third communication channel 4*c*3 is closed by the channel switching section 11, the first and second bifurcation channels 4*c*1 and 4*c*2 communicate with the return channel 4*c*. By contrast, when the channel switching section 11 closes the first and second connections between the first communication channels 4*c*1 and 4*c*2 and the return channel 4*c*, the return channel 4*c* communicates with the air suction port 6 via the third communication channel 4*c*3.

The first opening 9 is disposed upstream from the heat exchange channels 4*b* in the airflow direction in the forward channel 4*a*. The second opening 10 is disposed between the heat exchange channels 4*b* and the channel switching section 11. The airflow temperature sensor 12 is disposed upstream and adjacent to the second opening 10 in the airflow direction in the return channel 4*c*. The airflow temperature sensor 12 transmits to the switching controller 14 outputs corresponding to the temperature of the conditioning airflow detected. Additionally, the ambient temperature sensor 13 transmits to the switching controller 14 detection results corresponding to the temperature (i.e., ambient temperature) outside the apparatus detected. Based on the outputs from the airflow temperature sensor 12 and the ambient temperature sensor 13, the switching controller 14 causes the channel switching section 11 to switch the connection of the return channel 4*c* to either the circulating route or the external-air intake route.

It is to be noted that the first and second openings 9 and 10 specify the positions of the forward channel 4*a* and the return channel 4*c*, respectively. The forward channel 4*a* and the return channel 4*c* communicate with each other, with a predetermined opening area secured throughout, from the air supply port 5 to the air suction port 6, or from the air supply port 5 to the second external vent 8 although the opening area may differ partly.

The air conditioner 3 is disposed outside a body housing of the image forming apparatus 200 (on the lower left in FIGS. 1A and 1B). The airflow generated by the air conditioner 3 passes through the air supply port 5, the first opening 9, the forward channel 4*a*, and the heat exchange channels 4*b*-1 and 4*b*-2, and exchanges heat with the first and second conditioning targets 2-1 and 2-2. After the heat exchange, the conditioning airflow flows through the return channel 4*c* and is discharged from the air suction port 6 or the second external vent 8. When the conditioning airflow that has been circulated inside the apparatus (hereinafter also "circulated air") flows out from the air suction port 6, the circulated airflow is returned to the air conditioner 3. When the circulated airflow flows out from the second external vent 8, it is discharged outside the apparatus. Thus, the temperature of the first and second conditioning targets 2-1 and 2-2 can be adjusted to a desired temperature by controlling the temperature of the airflow from the air conditioner 3 and sending the airflow to the first and second conditioning targets 2-1 and 2-2.

As described above, FIG. 1A illustrates circulation type air conditioning, in which the air suction port 6 is connected to the second opening 10. In this state, after passing through the first and second conditioning targets 2-1 and 2-2, the conditioning airflow flows through the return channel 4*c*, the second opening 10, and the air suction port 6 and returns to the air conditioner 3. While the air conditioner 3 performs cooling, the conditioning airflow is cooled in a heat exchanger of the air conditioner 3, and the cooled conditioning airflow is supplied again from the air supply port 5 to the air-conditioning channel 4. Similarly, while the air conditioner 3 performs heating, the conditioning airflow is heated in the heat exchanger of the air conditioner 3, and the heated conditioning airflow is again supplied from the air supply port 5 to the air-conditioning channel 4.

FIG. 1B illustrates the state for intake and exhaust type air conditioning. In this case, the air suction port 6 and the first external vent 7 communicate with each other, and the second opening 10 and the second external vent 8 communicate with each other. After passing through the first and second conditioning targets 2-1 and 2-2, the conditioning airflow flows through the return channel 4*c*, the second opening 10, and the air suction port 6 and returns to the air conditioner 3. Further, air outside the image forming apparatus 200 passes through the first external vent 7 and the air suction port 6 and is sucked in by the air conditioner 3. While the air conditioner 3 performs cooling, external air drawn in is cooled by the heat exchanger of the air conditioner 3 and then is supplied through the air supply port 5 to the air-conditioning channel 4. Similarly, while the air conditioner 3 performs heating, external air drawn in is heated by the heat exchanger of the air conditioner 3 and then is supplied through the air supply port 5 to the air-conditioning channel 4.

The air-conditioning type can be switched between the circulation type shown in FIG. 1A and the intake and exhaust type shown in FIG. 1B by the channel switching section 11 including a solenoid valve (SV), for example. Switching operation of the solenoid of the channel switching section 11 can be instructed by the switching controller 14 according to the detection by the airflow temperature sensor 12 and the ambient temperature sensor 13.

In the image forming apparatus 200 according to the present embodiment, temperature inside the apparatus can be saturated when image formation on sheets is continued for a long time. To keep the conditioning target 2 at the desired temperature in this state, it is necessary that airflow temperature at the air supply port 5 is at 20° C., for example. When the conditioning airflow at 20° C. is supplied to the air supply port 5, airflow temperature at the second opening 10 is 28° C.

Figure 2A:
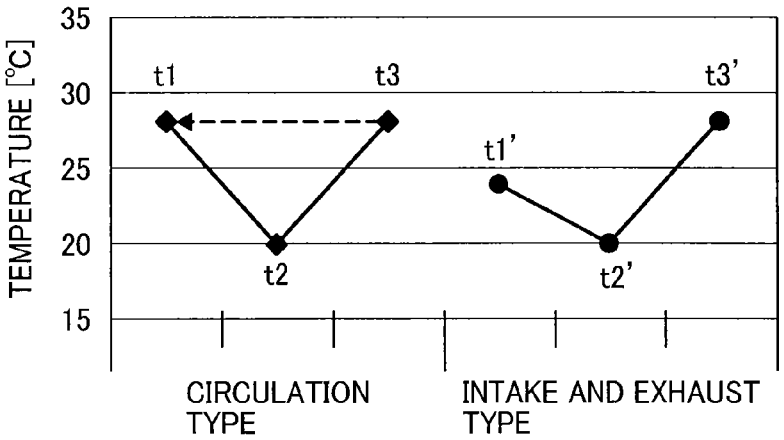
FIGS. 2A and 2B are graphs of airflow temperature at an air suction port, an air supply port and a second opening in circulation type and intake and exhaust type air conditioning when image formation is performed for a long time.

FIG. 2A is a graph of airflow temperature at the air suction port 6, the air supply port 5, and the second opening 10 in the circulation type air conditioning and the intake and exhaust type air conditioning when image formation is performed for a long time by the image forming apparatus 200 under an ambient temperature of 24° C.

In FIG. 2A, reference characters t1, t2, and t3 respectively represent airflow temperature at the air suction port 6, that at the air supply port 5, and that at the second opening 10 in the circulation type air conditioning. Since the air suction port 6 communicates with the second opening 10, temperatures t1 and t3 are approximately equal (t1≈t3) and can be deemed at 20° C. (t1=t3=20° C.). Since the temperature t2 is 28° C., the air conditioner 3 cools the airflow from 28° C. to 20° C.

By contrast, reference characters t1', t2', and t3' in FIG. 2A respectively represent temperature at the air suction port 6, the air supply port 5, and the second opening 10 in the intake and exhaust type air conditioning. In the intake and exhaust type air conditioning, the air conditioner 3 cools the airflow from 24° C. to 20° C. (t1'=24° C., t2'=20° C., and t3'=20° C.).

The amount of work of the air conditioner 3 to keep the conditioning target 2 at the desirable temperature is proportional to the difference between the airflow temperature (t1 or t1') at the air suction port 6 and the airflow temperature (t2 or t2') at the air supply port 5. Accordingly, the amount of work in the intake and exhaust type (with the temperature difference of 4° C.) can be half the amount of work in the circulation type (with the temperature difference of 8° C.).

Figure 2B:
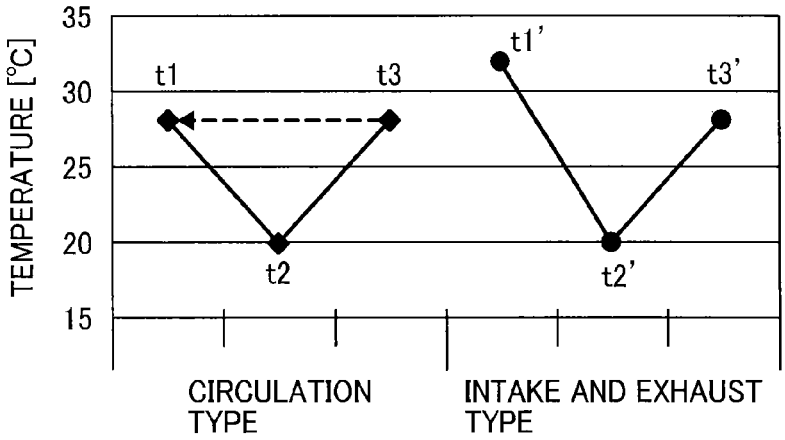

FIG. 2B is a graph of airflow temperature at the air suction port 6, the air supply port 5, and the second opening 10 in the circulation type air conditioning and the intake and exhaust type air conditioning when image formation is performed for a long time by the image forming apparatus 200 under an ambient temperature of 32° C.

Similarly to the case shown in FIG. 2A, the air suction port 6 communicates with the second opening 10 in the circulation type air conditioning, and the temperatures t1 and t3 are approximately equal and can be deemed at 28° C. (t1=t3=28° C.). Since the temperature t2 is 20° C., the air conditioner 3 cools the airflow from 28° C. to 20° C.

By contrast, in the intake and exhaust type air conditioning, the air conditioner 3 cools the airflow from 32° C. to 20° C. (t1'=32° C., t2'=20° C., and t3'=28° C.).

The amount of work of the air conditioner 3 to keep the conditioning target 2 at the desirable temperature is proportional to the difference between the airflow temperature (t1 or t1') at the air suction port 6 and the airflow temperature (t2 or t2') at the air supply port 5. Accordingly, the amount of work in the intake and exhaust type (with the temperature difference of 12° C.) can be greater by half than the amount of work in the circulation type (with the temperature difference of 8° C.).

Thus, in the case shown in FIG. 2A, air conditioning is switched to the intake and exhaust type shown in FIG. 1B since the amount of work is smaller by half compared with the circulation type. In the case shown in FIG. 2B, since the amount of work in the intake and exhaust type air conditioning is greater by half, air conditioning is switched to the circulation type shown in FIG. 1A.

In other words, in the present embodiment, the switching controller 14 controls the channel switching section 11 to make the difference in airflow temperature between the air suction port 6 and the air supply port 5 smaller by switching air conditioning between the circulation type and the intake and exhaust type. More specifically, the airflow temperature at the air supply port 5 to keep the air-conditioning targets 2 at the desired temperature is identical between the circulation type and the intake and exhaust type. Accordingly, the channel switching section 11 is controlled so that the air conditioner 3 sucks in either of air adjacent to the second opening 10 and the external air, the cooler of the two.

It is to be noted that, in the case of cooling, it is desirable that air conditioning is started in the intake and exhaust type when the image forming apparatus 200 is turned on and the operation is started. When the image forming apparatus 200 is powered on and the operation is started, regardless of the operation mode, temperature of air inside the apparatus rises, and accordingly temperature of exhaust rises.

In the circulation type air conditioning, the heated air (i.e., circulated air) is sucked in, and it is necessary to cool the heated air. By contrast, the cooling can be obviated in the intake and exhaust type air conditioning since external air is sucked in. That is, in the circulation type, the air is cooled by the degree corresponding to the heating and is less efficient than the intake and exhaust type. By contrast, in the intake and exhaust type, not the circulated air heated by the conditioning target 2 but external air is sucked in, and efficiency in air conditioning is not degraded.

Figure 3:
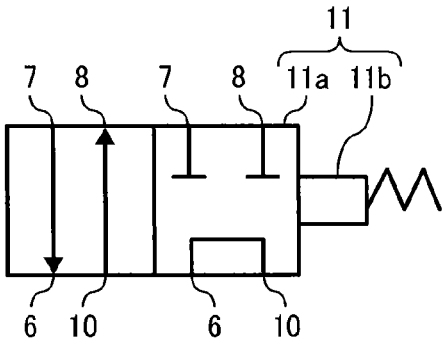
FIG. 3 is a schematic diagram of a direction control valve of an airflow channel selector driven by a solenoid.

FIG. 3 is a schematic diagram illustrating a configuration of the direction control valve to switch the airflow channel, driven by a solenoid.

In FIG. 3, the channel switching section 11 includes a direction control valve 11*a*, a solenoid 11*b* to drive the direction control valve 11*a*, and a driver to drive the solenoid 11*b*. The direction control valve 11*a* can be a so-called four-way two-position valve. When the direction control valve 11*a* is at the position shown in FIG. 3 (i.e., an initial position), the first external vent 7 communicates with the air suction port 6, the second external vent 8 communicates with the second opening 10, and the air suction port 6 and the second opening 10 do not communicate with each other. That is, this state is for air intake and exhaust. When the solenoid 11*b* is turned on in this state, the solenoid 11*b* moves to the left and blocks the first and second external vents 7 and 8. Then, the air suction port 6 communicates with the second opening 10.

It is to be noted that the driver drives the direction control valve 11*a* according to instructions from the switching controller 14. Since the solenoid 11*b* is turned on and off by the driver, the switching controller 14 recognizes the position of the direction control valve 11*a* as an on-state or off-state.

Further, the direction control valve 11*a* may be driven by a motor instead of the direction control valve 11*a*. In this case, a sensor or encoder can be provided to a drive force converter to convert the driving force of the motor into slide movement or a decelerator so that the position or state of the direction control valve 11*a* can be recognized.

As described above, according to the present embodiment, the suction side of the air conditioner 3 can be switched to that of the air-conditioning type in which the amount of work is smaller, thus enabling energy-efficient air conditioning.

(Second Embodiment)

Figure 4:
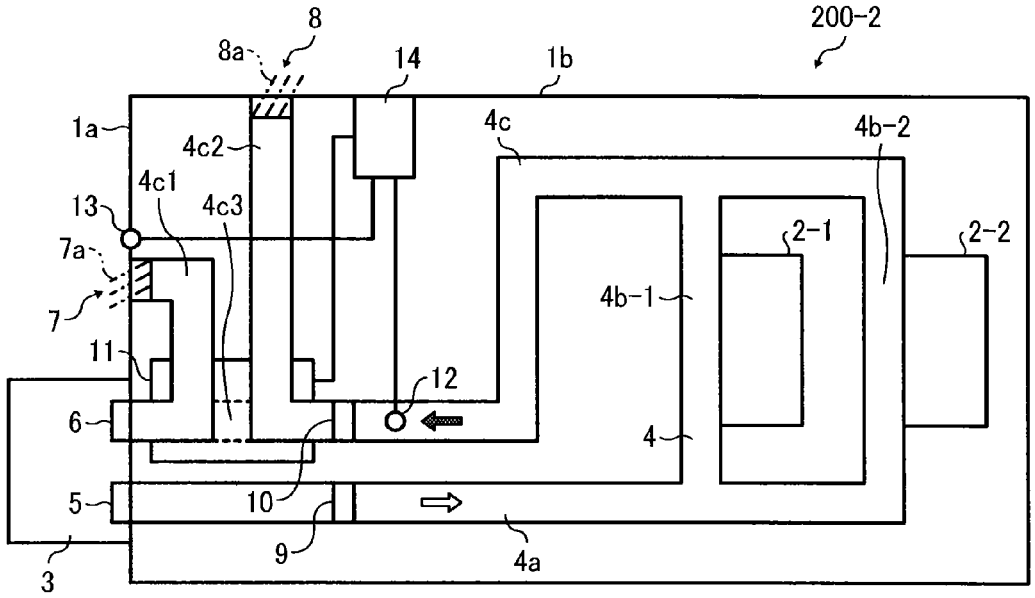
FIG. 4 is a schematic front view of an image forming apparatus according to a second embodiment.

FIG. 4 is a schematic front view of an image forming apparatus 200-2 according to a second embodiment. The present embodiment is different from the first embodiment in that the position of the second external vent 8 is changed. Other elements have configurations similar to those of the first embodiment and function similarly.

In the image forming apparatus 200-2 shown in FIG. 4, the first external vent 7 is formed in a side face 4*a* of the apparatus body, and the second external vent 8 is formed in an upper face 1*b* of the apparatus body. In this configuration, when the air suction port 6 and the first external vent 7 communicate with each other, and the second opening 10 and the second external vent 8 communicate with each other, air exhausted from the second external vent 8 diffuses upward. By contrast, the possibility that the exhaust from the second external vent 8 moves round to the first external vent 7 can be small since the distance between the first and second external vents 7 and 8 is greater and the first and second external vents 7 and 8 are formed in the different faces of the apparatus body. Accordingly, this configuration can inhibit heated air exhausted from the second external vent 8 from being sucked in through the first external vent 7.

Thus, the air conditioner 3 can suck in ambient air (external air) cooler than the exhausted air, securing the effects of the intake and exhaust type air conditioning.

Although the first and second external vents 7 and 8 are respectively formed in the side face 4*a* and the upper face 1*b* of the apparatus body in the present embodiment, the arrangement can be different from that shown in FIG. 4 as long as air can be inhibited from moving round from one of the first and second external vents 7 and 8 to the other. More specifically, the faces in which these vents are formed are not limited to the side face 1*a* and the upper face 1*b* as long as the arrangement of the air vents can inhibit the first external vent 7 from sucking in the exhaust air discharged from the second external vent 8.

For example, the first external vent 7 may be formed in the front face of the apparatus body that is less likely to face a wall of the room in which the image forming apparatus 200-2 is installed, and the second external vent 8 may be formed in a face other than the front face. Further, in arrangements in which the first and second external vents 7 and 8 are formed in an identical face of the apparatus body, air can be inhibited from moving from one of the vents to the other vent when the distance therebetween is relatively long. Yet further, as shown in FIG. 4, a louver 7*a* can be provided to the first external vent 7 to inhibit suction of air on the side of the second external vent 8. Alternatively, a louver 8*a* may be provided to the second external vent 8 to guide the exhaust to a side away from the first external vent 7.

When the first and second external vents 7 and 8 are formed in an identical face of the apparatus body, it is effective that the louvers 7*a* and 8*a* are oriented in the different directions.

Yet alternatively, a fan can be used instead of the louver 8*a*. When the angle setting of the louver 8*a* is adopted as the angle setting of the fan, the exhaust from the second external vent 8 can be guided in the direction specified. This arrangement can inhibit the first external vent 7 from sucking in the exhaust discharged from the second external vent 8.

It is to be noted that the second embodiment is effective in the intake and exhaust type air conditioning. In the circulation type air conditioning, the heated air exhausted from the second external vent 8 is not sucked in since external air is not introduced.

As described above, the arrangement according to the present embodiment can inhibit the exhaust from the second external vent 8 from being sucked in through the first external vent 7.

(Third Embodiment)

Figure 5:
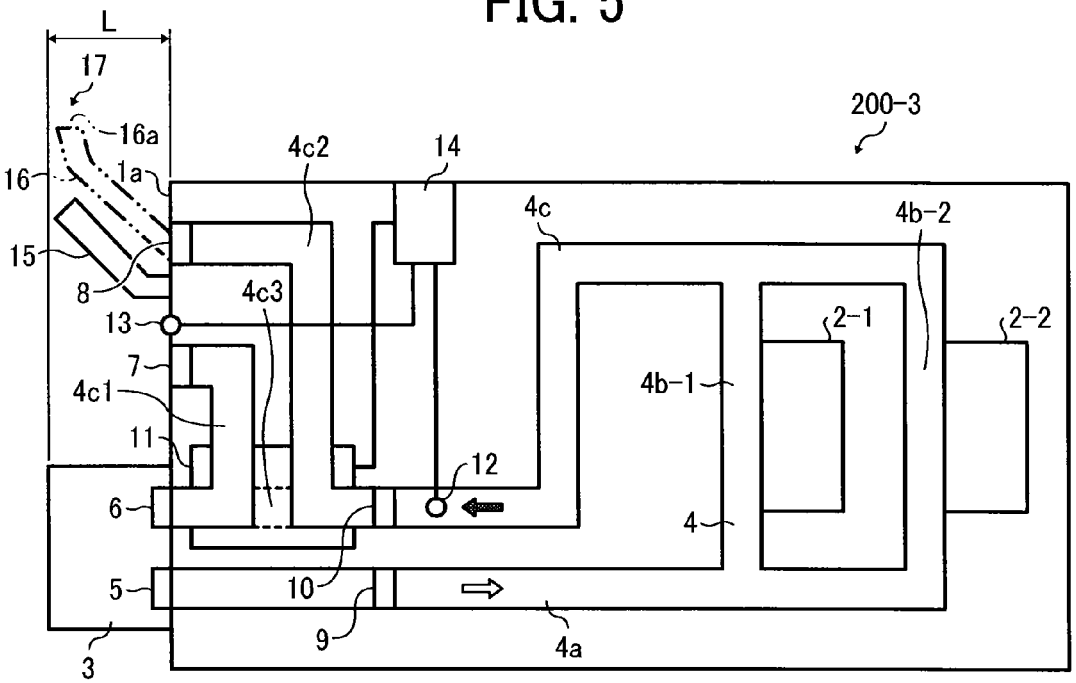
FIG. 5 is a schematic front view of an image forming apparatus according to a third embodiment.

FIG. 5 is a schematic front view of an image forming apparatus 200-3 according to a third embodiment. The present embodiment is different from the first embodiment in that a planar shield 15 is disposed between the first external vent 7 and the second external vent 8 to divide a space extending from the first and second external vents 7 and 8. Other elements have configurations similar to those of the first embodiment and function similarly.

In the image forming apparatus 200-3 shown in FIG. 5, both the first external vent 7 and the second external vent 8 are formed in the side face 1*a* of the apparatus body, and the planar shield 15 is disposed therebetween in the vertical direction in FIG. 5.

In the intake and exhaust type air conditioning, in which the air suction port 6 communicates with the first external vent 7 and the second opening 10 communicates with second external vent 8, the planar shield 15 positioned between the first and second external vents 7 and 8 can guide air exhausted from the second external vent 8 to a position away from the first external vent 7 along the surface of the planar shield 15. With this configuration, the air conditioner 3 can secure the effects attained by the intake and exhaust type air conditioning.

The planar shield 15 is configured to prevent air discharged from the second external vent 8 from moving round to the first external vent 7 and vice versa, and the configuration is not limited to that shown in FIG. 5 as long as this effect is available. For example, even if the first and second external vents 7 and 8 are formed in the different faces of the apparatus body, it is possible that air moves round from one of the first and second external vents 7 and 8 to the other vent depending on the environmental conditions around the apparatus. For example, it is possible when the apparatus is disposed adjacent or close to a wall 17. In such a case, providing the planar shield 15 between the first and second external vents 7 and 8 can inhibit air from moving round from one of the two air vents to the other air vent.

Therefore, it is advantageous that the apparatus body is provided with multiple fasteners to fix the planar shield 15 so that the planar shield 15 can be attached at one of multiple predetermined positions depending on the environment in which the apparatus is installed.

In FIG. 5, reference character L represents the amount by which the planar shield 15 projects from the side face 1*a* (hereinafter "projecting amount L"). It is preferable that the projecting amount L is identical or similar to the size of the air conditioner 3 in the direction in which the planar shield 15 projects. With this configuration, when the apparatus is disposed with the side face 1*a* of the apparatus body adjacent to the wall 17, the end of the planar shield 15 can contact or nearly reach the wall 17, thus effectively inhibiting air from moving round from the end of the planar shield 15.

Additionally, a sheet tray (such as the discharge sheet tray 218 shown in FIG. 11) may be configured as the planar shield 15. Specifically, the discharge tray serving as the planar shield 15 is disposed on the lower side of a discharge port through which sheets are discharged after images are formed thereon. The first external vent 7 is disposed beneath the discharge tray, and the second external air bent 8 is disposed above the discharge tray. When an existing sheet tray of the image forming apparatus 200 is used as the planar shield 15, the number and cost of components can be reduced.

When the discharge tray serves as the planar shield 15, the discharge tray and the second external vent 8 may be arranged to guide the exhaust from the second external vent 8 to the sheet discharged on the discharge tray. This configuration is advantageous in that the sheet immediately after image fixing can be cooled by the air exhausted through the second external vent 8. Additionally, when the exhausted air enters under the subsequent sheet being discharged, an air layer can be created between the preceding sheet stacked on the discharge tray and the subsequently sheet, thus inhibiting the subsequent sheet from adsorbing or adhering to the preceding sheet. When adsorption or adhesion of sheets is prevented, defective alignment and discharge of sheets caused thereby can be eliminated.

In addition, the second external vent 8 may be capped with a duct 16 so that air is exhausted from an opening 16*a* at the end of the duct 16. In this case, when the opening 16*a* faces upward as indicated by chain double-dashed lines in FIG. 5, heated air can be discharged upward. This arrangement can lower the possibility that the first external vent 7 sucks in the air exhausted from the second external vent 8.

It is to be noted that also the third embodiment is effective in the intake and exhaust type air conditioning. In the circulation type air conditioning, external air is not introduced, and thus the heated air exhausted from the second external vent 8 is not sucked in.

As described above, the arrangement according to the present embodiment can inhibit the exhaust from the second external vent 8 from being sucked in through the first external vent 7.

Figure 6A:
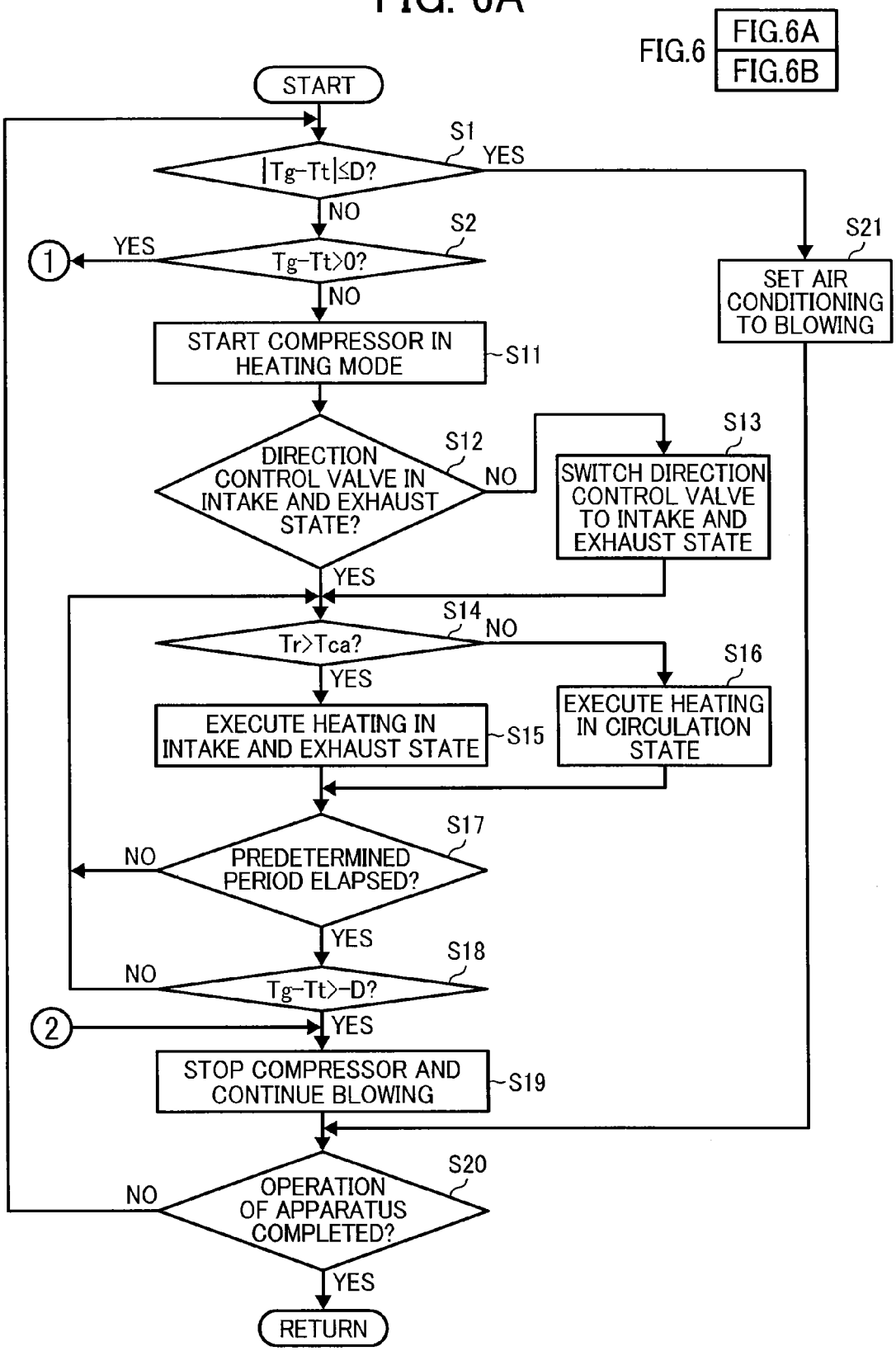
FIGS. 6A and 6B are flowcharts illustrating a procedure of switching of an airflow channel inside the image forming apparatus according to the first embodiment.
Figure 6B:
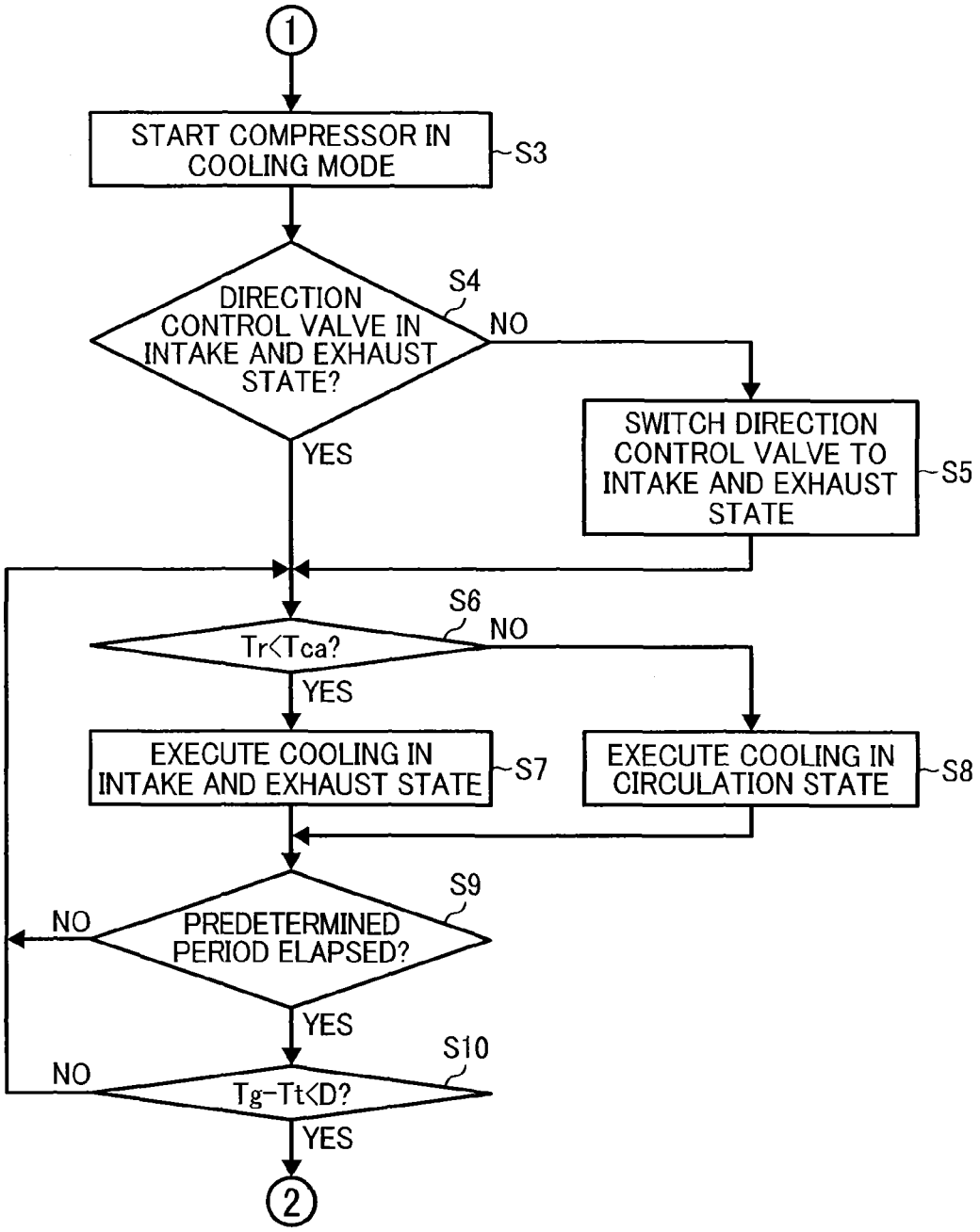

FIGS. 6A and 6B are flowcharts illustrating procedure performed by the channel switching section 11 to switch the airflow route inside the image forming apparatus 200 according to the first embodiment.

For example, the central processing unit (CPU) of the switching controller 14 instructs the channel switching section 11 to perform the switching. The CPU can include a control unit and a computation unit. The control unit interprets commands and controls flow of control programs. The computation unit executes computation. The programs are stored in a memory unit. Commands (numerals or lines of numerals) to be executed are retrieved from the memory unit storing the programs, and the programs are executed.

To the switching controller 14, detection results output from the airflow temperature sensor 12 and the ambient temperature sensor 13 are input, and the CPU acquires temperature of the conditioning airflow after heat exchange and external air temperature based on the detection results. Additionally, results of detection at each conditioning target 2 are input to the switching controller 14, and the CPU acquires the temperature of the conditioning target 2 based on the detection results.

While the image forming apparatus 200 operates, the CPU switches the air conditioner 3 between cooling mode and heating mode based on the relation between a temperature Tg of the conditioning target 2 detected by the sensor (i.e., detection value of the sensor) and a target temperature Tt of the conditioning target 2. Alternatively, the air conditioner 3 can be operated in a predetermined pattern in accordance with operation data such as operation pattern or operation time. The following procedure concerns a case in which switching between cooling and heating is determined based on the relation between the detected temperature Tg of the conditioning target 2 and the target temperature Tt.

In FIGS. 6A and 6B, when the air conditioner 3 starts air conditioning, initially the difference between the detected temperature Tg is acquired, and the difference is compared with a preset difference D that is an integer greater than zero. According to the preset difference D, the air-conditioning mode is selected from cooling (S11), heating (S3), and blowing (S21). The preset difference D can be preset experimentally for each apparatus type.

At S1, whether the following formula is true or false (Yes or No) is judged.

$$|Tg-Tt| \leq D \qquad \text{Formula 1}$$

If the value |Tg−Tt| is greater than the preset difference D (No at S1), the air conditioner 3 performs either cooling or heating. Further, at S2, whether the following formula is true or false is judged.

$$Tg-Tt>0 \qquad \text{Formula 2}$$

The detected temperature Tg of the conditioning target 2 can be any of a temperature detected at the predetermined one among the multiple conditioning targets 2, a mean value of multiple detected temperatures, and the lowest among the multiple detected temperatures, for example. In any case, the detected temperature Tg of the conditioning target 2 is selected based on predetermined criteria to set the conditioning target 2 serving as a reference in the comparison.

When the difference calculated at S2 is greater than zero (Yes at S2), it means that the temperature of the conditioning target 2 is higher than the target temperature Tt. Accordingly, when the difference is greater than zero, at S3 the air conditioner 3 enters cooling mode, and operation of the compressor 101 is started.

Subsequently, the state (i.e., position) of the direction control valve 11*a* of the channel switching section 11 is checked. Specifically, at S4 whether the direction control valve 11*a* is in the state for air intake and exhaust is checked. The state for air intake and exhaust means that the air suction port 6 communicates with the first external vent 7, and the second opening 10 communicates with the second external vent 8. When the direction control valve 11*a* is positioned for the air intake and exhaust state (Yes at S4), this state is kept. When not positioned for that state, the position of the direction control valve 11*a* is switched at S5. That is, in the control flow shown in FIGS. 6A and 6B, air conditioning is set for air intake and exhaust in the initial state.

At S6, an ambient temperature Tr detected by the ambient temperature sensor 13 is compared with a temperature Tca detected by the airflow temperature sensor 12 as expressed by the following formula.

$$Tr<Tca \qquad \text{Formula 3}$$

It is to be noted that the CPU converts the detection results output from the ambient temperature sensor 13 and the airflow temperature sensor 12 into the ambient temperature Tr and the temperature Tca.

When the formula 3 is true, that is, the ambient temperature Tr detected by the ambient temperature sensor 13 is lower than the temperature Tca detected by the airflow temperature sensor 12 (Yes at S6), cooling is executed in the air intake and exhaust state at S7. When the ambient temperature Tr is equal to or higher than the temperature Tca of the conditioning airflow (Tr≥Tca, No at S6), the position of the direction control valve 11*a* is switched, and cooling is executed in the circulation state at S8.

At S9, whether or not a predetermined period has elapsed is judged. Until the predetermined period elapses, the process starting from step S6 is executed, and cooling is executed at S7 or S8 depending on the temperature. When the predetermined period has elapsed (Yes at S9), at S10 whether the detected temperature Tg minus the target temperature Tt is smaller than the preset difference D, that is, whether the following formula is true, is judged.

$$Tg-Tt<D \qquad \text{Formula 4}$$

When it is judged "false" (Tg−Tt≥D), the process returns to step S6, and the process starting from step S6 is repeated. At the time point when Tg−Tt becomes smaller than the preset difference D, it is deemed that the temperature of the conditioning target 2 is at the target temperature. Then, the compressor 101 is stopped, and blowing is continued.

By contrast, at S2, if the difference between the detected temperature Tg and the target temperature Tt is smaller than zero (Tg−Tt<0, No at S2), it means that the detected temperature Tg of the conditioning target 2 is lower than the target temperature Tt. Therefore, when the difference is smaller than zero, the air conditioner 3 enters heating mode, and the compressor 101 is started at S11.

Subsequently, the state (i.e., position) of the direction control valve 11*a* of the channel switching section 11 is checked. Specifically, at S12 whether the direction control valve 11*a* is in the state for air intake and exhaust is checked. When the direction control valve 11*a* is in the air intake and exhaust state, this state is kept. When not in this state, the position of the direction control valve 11*a* is switched at S13.

At S14, the ambient temperature Tr detected by the ambient temperature sensor 13 is compared with the temperature Tca detected by the airflow temperature sensor 12.

$$Tr>Tca \qquad \text{Formula 5}$$

When the ambient temperature Tr is higher than the detected temperature Tca of the conditioning airflow (Yes at S14), the position of the direction control valve 11*a* is switched, and heating is executed in the air intake and exhaust state at S15. By contrast, when the ambient temperature Tr is equal to or lower than the temperature Tca of the conditioning airflow (Tr≤Tca, No at S14), the position of the direction control valve 11*a* is switched, and heating is executed in the circulation state at S16.

At S17, whether or not a predetermined period has elapsed is judged. Until the predetermined period elapses, the process starting from step S14 is executed and heating is executed at S15 or S16 depending on the temperature. When the predetermined period has elapsed (Yes at S17), at S18 whether the detected temperature Tg minus the target temperature Tt is greater than the preset difference D in the minus direction, that is, whether the following formula is true, is judged.

$$Tg-Tt>-D \qquad \text{Formula 6}$$

When it is judged "false" (Tg−Tt≤−D), the process returns to step S14, and the process starting from step S14 is repeated. At the time point when the formulate 6 becomes true (Tg−Tt>−D), it is deemed that the temperature of the conditioning target 2 is at the target temperature. Then, the compressor 101 is stopped, and blowing is continued at S19. At S20, whether or not the operation of the image forming apparatus 200 is completed is judged. When the operation is completed, the process starting from S1 is repeated.

By contrast, at S1, when the absolute value of the difference Tg−Tt is not greater than the preset difference D (Yes at S1), neither heating nor cooling is required. Accordingly, the compressor 101 is stopped, and blowing is performed at S21. Then, the process proceeds to step 20.

With this control, in cooling, the air supplied to the air suction port 6 of the air conditioner 3 can be constantly one of external air or the circulated airflow (conditioning airflow) that is cooler. Thus, the conditioning airflow at the predetermined temperature can be generated with a smaller amount of energy.

By contrast, in heating, the air supplied to the air suction port 6 of the air conditioner 3 can be constantly one of external air or the circulated airflow (conditioning airflow) that is warmer. Thus, the conditioning airflow at the predetermined temperature can be generated with a smaller amount of energy.

It is to be noted that a step similar to S20 to check completion of operation of the apparatus may be added as a step prior to S9 (before S7 and S8), and as a step prior to S17 (before S15 and S16). In this case, when the judgment at the added step is "No", the process proceeds to S9 or S17. By contrast, when the judgment is "Yes", the process returns to S20. With this configuration, image forming operation can be checked more closely, and results thereof can be fed back to air-conditioning control. Accordingly, air conditioning can be controlled more closely, thus enhancing energy saving effects.

Additionally, in the control procedure shown in FIGS. 6A and 6B, although the switching controller 14 causes the channel switching section 11 to switch the direction control valve 11*a* according to whether the ambient temperature Tr is lower than the detected temperature Tca (Tr<Tca), the frequency of switching is expected to increase in this method.

Therefore, in cooling, using a setting C as a reference, the switching controller 14 sets the direction control valve 11*a* in the air intake and exhaust state when Tr−Tca<−C; keeps the previous state when |Tr−Tca|≤C; and sets the direction control valve 11*a* in the circulation state when C<Tr−Tca.

By contrast, in heating, using the setting C as a reference, the switching controller 14 sets the direction control valve 11*a* in the air intake and exhaust state when C<Tr−Tca; keeps the previous state when |Tr−Tca|≤C; and sets the direction control valve 11*a* in the circulation state when Tr−Tca<−C.

The setting C is determined through simulation or experiments so that switching is not frequent and energy saving effects of the air conditioner 3 can be sufficient. It is to be noted that, although channel switching in the channel switching section 11 can be made at once by the solenoid 11*b*, switching between cooling and heating is not instantaneous and requires time for switching of the four-way valve 105, transition to steady state, and the like.

As described above, according to the present embodiment, in cooling operation, the air conditioner 3 can suck in the cooler of external air and the circulated air. Thus, power consumed by the air conditioner 3 can be reduced.

Additionally, in heating operation, the air conditioner 3 can suck in the warmer of external air and the circulated air. Thus, power consumed by the air conditioner 3 can be reduced.

(Fourth Embodiment)

Figure 7:
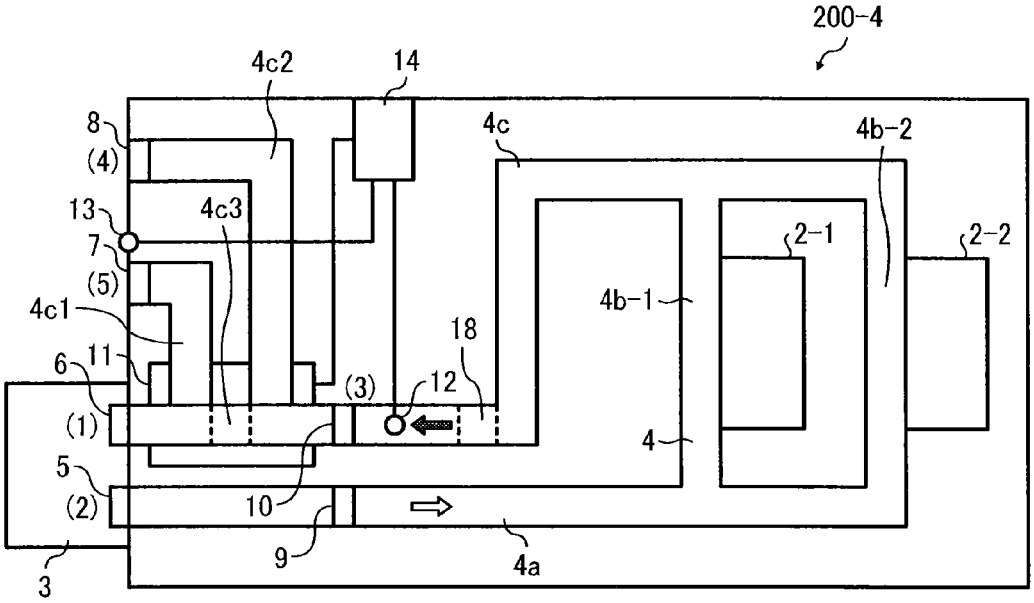
FIG. 7 is a schematic front view of an image forming apparatus according to a fourth embodiment.

FIG. 7 is a schematic front view of an image forming apparatus 200-4 according to a fourth embodiment. The present embodiment is different from the first embodiment in that a filter 18 is provided adjacent to and upstream from the second opening 10 of the return channel 4*c*. Other than that, the image forming apparatus 200-4 according to the present embodiment has configurations similar to those of the image forming apparatus 200 according to the first embodiment.

In the present embodiment, the filter 18 is positioned between the conditioning target 2 and the second opening 10 and extends over the entire cross sectional area of the return channel 4*c*. The filter 18 is configured to block toner, paper powder (or paper dust), dust, and the like flowing through the return channel 4*c*. That is, the filter 18 is provided to remove toner, paper powder, dust, and the like flowing through the return channel 4*c*. In the present embodiment, the filter 18 is situated between the conditioning target 2 and the second opening 10. Accordingly, an identical filter 18 can remove such materials in either of the circulation type and the intake and exhaust type.

(Fifth Embodiment)

Figure 8:
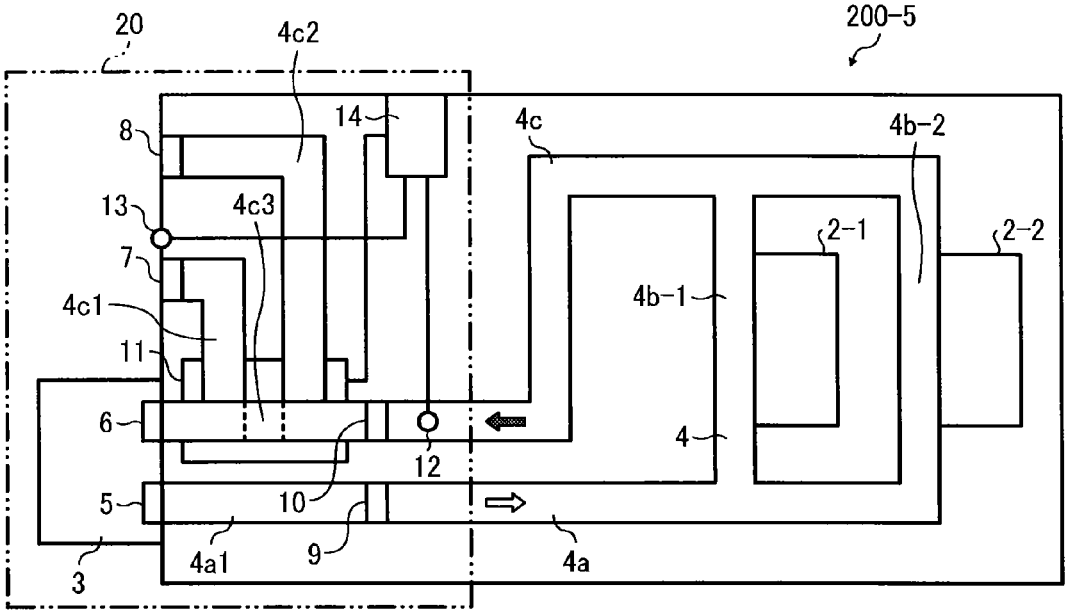
FIG. 8 is a schematic front view of an image forming apparatus according to a fifth embodiment.

FIG. 8 is a schematic front view of an image forming apparatus 200-5 according to a fifth embodiment. The image forming apparatus 200-5 is configured such that the air conditioner 3 according to the first embodiment is extended into an air-conditioning unit 20 that includes an upstream portion of the forward channel 4*a*, the first bifurcation channel 4*c*1, the second bifurcation channel 4*c*2, and the third communication channel 4*c*3, which are downstream portions of the return channel 4*c*, the channel switching section 11, the first and second openings 9 and 10, the switching controller 14, and the ambient temperature sensor 13. Extending the air conditioner 3 into the extended air-conditioning unit 20 is advantageous in that the air-conditioning unit 20 can be optionally connected to the apparatus body that is not provided with an air conditioner.

With this configuration, the user can determine whether to use the optional air-conditioning unit 20 considering convenience and installation environments.

Other portions have configurations similar to those of the first embodiment and function similarly. Additionally, the present embodiment can adopt the control procedure shown in FIGS. 6A and 6B.

Figure 9:
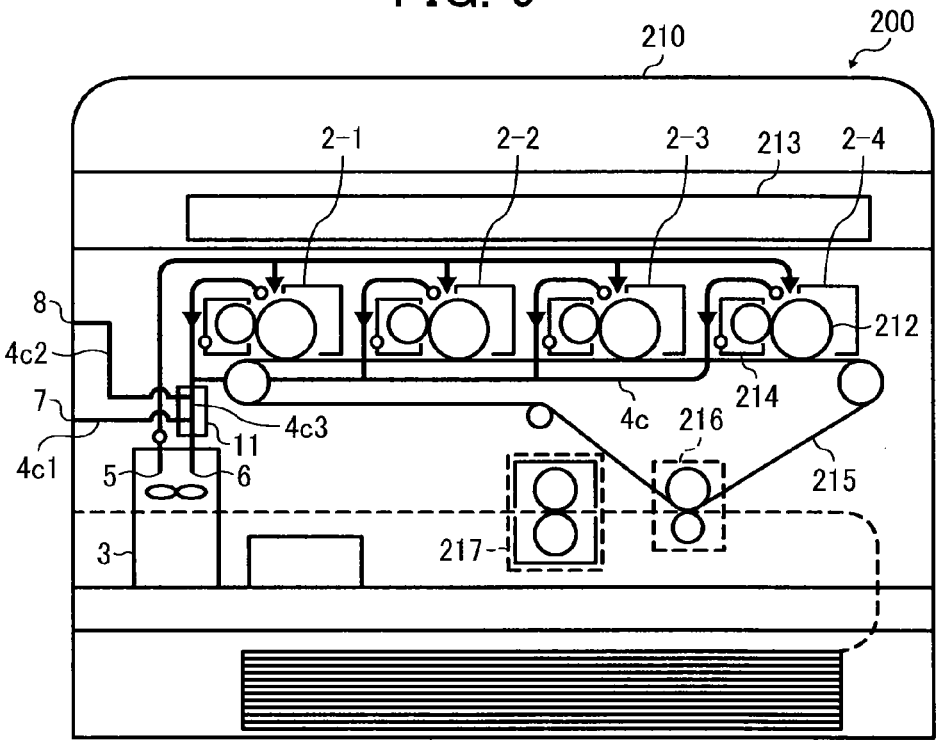
FIG. 9 schematically illustrates a configuration in which the air conditioner according to the first embodiment is incorporated in a tandem image forming apparatus.

FIG. 9 schematically illustrates a configuration in which the air-conditioning structure according to the first embodiment is incorporated in a multicolor tandem image forming apparatus of intermediate transfer type.

In the configuration shown in FIG. 9, the air-conditioning channel 4 is formed such that air is supplied from the air supply port 5 of the air conditioner 3 to the conditioning targets 2-1, 2-2, 2-3, and 2-4 and returned to the air suction port 6 after heat exchange in the air conditioner 3. In the present embodiment, the air-conditioning channel 4 is parallel to the conditioning targets 2-1, 2-2, 2-3, and 2-4 similarly to the first embodiment.

The conditioning targets 2-1, 2-2, 2-3, and 2-4 are image forming units each including the photoreceptor 212, the developing device 214, the cleaning unit, and the like. The conditioning targets 2-1, 2-2, 2-3, and 2-4 are disposed close to each other. In the present embodiment, the conditioning airflow flowing through the forward channel 4*a* is supplied to the image forming units serving as the conditioning targets 2-1, 2-2, 2-3, and 2-4. A substantial amount of air discharged from an outlet formed in each image forming unit is sucked in a suction port and collected in the return channel 4*c*. The collected air is returned to the air conditioner 3.

Since the conditioning airflow supplied to each image forming unit enters the developing device 214 due to airflow generated adjacent to the photoreceptor 212 and a developing roller, temperature adjacent to the photoreceptor 212 and inside the developing device 214 can be adjusted.

Figure 10:
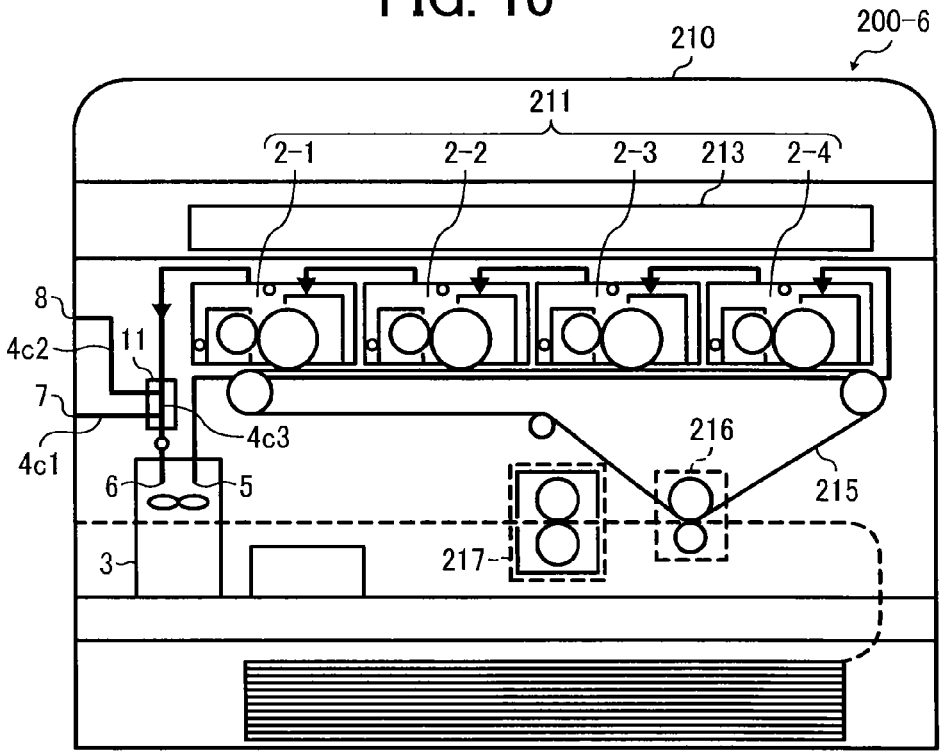
FIG. 10 is a variation of the configuration shown in FIG. 9.

FIG. 10 schematically illustrates a variation of the configuration shown in FIG. 9. The configuration shown in FIG. 10 is different from that shown in FIG. 9 in that the air-conditioning channel 4 is disposed serially to the conditioning targets 2-1, 2-2, 2-3, and 2-4. Similarly to that shown in FIG. 9, in the configuration shown in FIG. 10, air supplied from the air supply port 5 of the air conditioner 3 to the conditioning targets 2-1, 2-2, 2-3, and 2-4 is returned to the conditioning airflow after heat exchange in the air conditioner 3.

In the present embodiment, the heat exchange channels 4*b* are constructed of clearance between the conditioning targets 2-1, 2-2, 2-3, and 2-4 or clearance between the an inner wall of a mount for containing the tandem image forming unit 211 and the image forming units. When the clearance between the units and that between the inner wall of the mount and the unit is regarded as a duct, it is not fully closed. Accordingly, the conditioning airflow can leak. The amount of leak, however, is not significant from the viewpoint of the operational efficiency of the air conditioner 3, and air conditioning effects of the air conditioner 3 can be sufficient.

Other portions have configurations similar to those of the first embodiment and function similarly. The channel switching can be performed in the procedure shown in FIGS. 6A and 6B.

According to the embodiments described above, regardless of the temperature outside the apparatus body, air conditioning inside the apparatus can be executed using airflow generated in an energy-efficient method.

It is to be noted that the sequence of steps in the procedure of switching the air-conditioning channel is not limited to the description above.

Further, any of the aforementioned methods may be embodied in the form of a program. The program may be stored on a computer readable media and is adapted to perform any one of the aforementioned methods when run on a computer device (a device including a processor). Thus, the storage medium or computer readable medium is adapted to store information and is adapted to interact with a data processing facility or computer device to perform the method of any of the above mentioned embodiments.

Various aspects of the specification can attain the following effects.

1) An aspect of the specification provides the air-conditioning unit that includes the air conditioner 3 to control at least one of temperature and humidity, the forward channel 4*a* to guide air supplied from the air conditioner 3 to at least one conditioning target 2, the return channel 4*c* to guide air that has exchanged heat with the conditioning target 2 either to the air conditioner 3 or directly to the outside, the first bifurcation channel 4*c*1 bifurcating from the return channel 4*c* and leading to the first external vent 7 opened to the outside, the second bifurcation channel 4*c*2 bifurcating from the return channel 4*c* and leading to the second external vent 8 opened to the outside, and the channel switching section 11 that switches the air-conditioning channel, and the switching controller 14. The channel switching section 11 is for switching the airflow channel between the circulation type route including the third communication channel 4*c*3 and the external-air intake route to discharge air from the second external vent 8 of the second bifurcation channel 4*c*2 and to take in air in the air conditioner 3 from the first external vent 7 of the first bifurcation channel 4*c*1. The switching controller 14 causes the channel switching section 11 to switch the air-conditioning channel according to the results of comparison between the temperature inside the return channel 4*c* and external air temperature.

Accordingly, the external air temperature and the temperature of the circulated air that has passed through the conditioning targets 2 can be compared. Either of external air and the circulated air can be selected as the conditioning airflow, and supplied to the conditioning targets 2 after being cooled or heated. Accordingly, regardless of the temperature outside the apparatus body, air conditioning can be executed using airflow generated in an energy-efficient method.

2) The first and second external vents 7 and 8 are positioned so that the air exhausted from the second external vent 8 is not introduced from the first external vent 7 into the air conditioner 3. Accordingly, energy for generating the conditioning airflow is not wasted.

3) Since the first and second external vents 7 and 8 are positioned in the different faces (i.e., the side face 1*a* and the upper face 1*b*) of the apparatus body, the air exhausting direction and the air sucking-in direction can differ from each other, thus reducing the possibility that the exhaust from the second external vent 8 is introduced from the first external vent 7. Accordingly, energy for generating the conditioning airflow is not wasted.

4) Since the planar shield 15 to inhibit the air exhausted from the second external vent 8 from entering the first external vent 7 is provided between the first and second external vents 7 and 8, the exhaust can be prevented from being introduced through the first external vent 7. Accordingly, energy for generating the conditioning airflow is not wasted.

5) The second external vent 8 is disposed above the planar shield 15, and the first external vent 7 is disposed beneath the planar shield 15. Accordingly, heated air can move up and does not flow to the first external vent 7. Accordingly, energy for generating the conditioning airflow is not wasted.

6) When the planar shield 15 is constructed of the duct 16 communicating with the second external vent 8, this configuration can better inhibit the air exhausted from the second external vent 8 from being introduced through the first external vent 7. Accordingly, energy for generating the conditioning airflow is not wasted.

7) Since the filter 18 is provided in the return channel 4*c* that is an upstream portion of the return channel through which the conditioning airflow flows after heat exchange with the conditioning targets, toner, paper powder, and dust can be removed using only a single filter.

8) In cooling operation, when the external air temperature is lower than the temperature of air in the return channel 4*c*, the air-conditioning channel can be switched to the external-air intake route to exhaust air from the second external vent 8 and to take in air into the air conditioner 3 from the first external vent 7. By contrast, when the external air temperature is higher than the temperature of air in the return channel 4*c*, the air-conditioning channel can be switched to the circulation type route passing through the return channel 4*c* to the air conditioner 3. Thus, the amount of work done by the air conditioner 3 can be smaller. Accordingly, air conditioning can be performed in an energy-efficient manner.

9) In heating operation, when the external air temperature is higher than the temperature of air in the return channel 4*c*, the air-conditioning channel can be switched to the external-air intake route to exhaust air from the second external vent 8 and to take in air into the air conditioner 3 from the first external vent 7. By contrast, when the external air temperature is lower than the temperature of air in the return channel 4*c*, the air-conditioning channel can be switched to the circulation type route through which air is returned to the air conditioner 3 through the return channel 4*c* including the third communication channel 4*c*3. Thus, the amount of work done by the air conditioner 3 can be smaller. Accordingly, air conditioning can be performed in an energy-efficient manner.

10) In the initial setting at the start of operation of the air conditioner 3, the external-air intake route to exhaust air from the second external vent 8 and to take in external air from the first external vent 7 into the air conditioner 3 is used. This configuration can reduce the risk of degrading energy efficiency, and energy-saving effects can be secured.

11) When the air conditioner 3 is incorporated in the image forming apparatus 200, at least one of temperature and humidity inside the apparatus can be adjusted without wasting energy.

12) Since the image forming apparatus 200 includes the forward channel 4*a* to guide air supplied from the air conditioner 3 to the conditioning targets 2 and the return channel 4*c* through which the air is guided to the air conditioner 3 after the heat exchange with the conditioning targets 2, air conditioning inside the apparatus can be performed by easily connecting the air conditioner 3 to the image forming apparatus 200.

13) Use of the discharge sheet tray 218 as the planar shield 15 can obviate the necessity of providing the planar shield 15 separately.

14) When the discharge sheet tray 218 and the second external vent 8 are arranged such that air exhausted from the second external vent 8 is guided to the sheets discharged to the discharge sheet tray 218, cooling of the sheet can be facilitated, and close contact and adhesion of the sheet to another sheet can be inhibited.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an air-conditioning unit comprising:

an air conditioner to control air temperature;

a first channel to guide air supplied from the air conditioner to a conditioning target;

a heat exchange channel through which the air supplied from the air conditioner exchanges heat with the conditioning target;

a second channel to guide air from the conditioning target either outside the air-conditioning unit or to the air conditioner;

a processor configured to cause the air conditioner to suck in either external air or the air guided from the conditioning target; and a channel switching section that includes a direction control valve and a solenoid, the channel switching section is controlled by the processor, wherein the processor compares temperature of air in the second channel and external air temperature, wherein according to a result of comparison between the temperature of air in the second channel and the external air temperature, the processor switches an air-conditioning channel between a circulating route that includes the second channel and an external-air intake route to exhaust air from a second external vent and to introduce external air from a first external vent into the air conditioner, wherein the processor operates either the circulating route or the external-air intake route for a predetermined amount of time to determine if a difference between a temperature of the conditioning target and a target temperature for the conditioning target is within a predetermined range, wherein the air conditioner is disposed outside a body housing of the image forming apparatus, wherein the processor activates the solenoid to change a direction of the direction control valve to block the first and second external vents and open communication between the air conditioner and the second channel, and when the difference between the temperature of the conditioning target and the target temperature are within the predetermined range, a compressor of the air conditioner is turned off and the air conditioner continues to blow air, and wherein when the difference between the temperature of the conditioning target and the target temperature is less than zero, then the air conditioner enters a heating mode.

2. The image forming apparatus according to claim 1, further comprising:

a third channel bifurcating from the second channel and leading to the first external vent opened to the outside; and a fourth channel bifurcating from the second channel and leading to the second external vent opened to the outside.

3. The image forming apparatus according to claim 2, wherein the first and second external vents are positioned so that the air exhausted from the second external vent is not introduced into the air-conditioning unit from the first external vent.

4. The image firming apparatus according to claim 3, wherein the first and second external vents are positioned in different faces of the air-conditioning unit.

5. The image forming apparatus according to claim 2, further comprising a shield provided between the first and second external vents to inhibit the air exhausted from the second external vent from entering the first external vent.

6. The image forming apparatus according to claim 5, wherein the shield is planar, the second external vent is disposed above the planar shield, and the first external vent is disposed beneath the planar shield.

7. The image forming apparatus according to claim 5, wherein the shield comprises a duct communicating with the second external vent.

8. The image forming apparatus according to claim 2, further comprising a filter provided in the second channel positioned upstream from the fourth channel in a direction in which air flows inside the air-conditioning unit.

9. The image forming apparatus according to claim 2, further comprising at least one additional heat exchange channel through which the air supplied from the air conditioner exchanges heat with a conditioning target.

10. The image forming apparatus according to claim 2, wherein, to cool the conditioning target, the processor switches the air-conditioning channel to the external-air intake route when the external air temperature is lower than the temperature of air in the second channel, and the processor switches the air-conditioning channel to the circulating route when the external air temperature is higher than the temperature of air in the second channel.

11. The image forming apparatus according to claim 2, wherein, to heat the conditioning target, the processor switches the air-conditioning channel to the external-air intake route when the external air temperature is higher than the temperature of air in the second channel, and the processor switches the air-conditioning channel to the circulating route when the external air temperature is lower than the temperature of air in the second channel.

12. The image forming apparatus according to claim 2, wherein, when the air-conditioning unit starts operation, the external-air intake route is selected as the air-conditioning channel.

13. The image forming apparatus according to claim 1, further comprising:

a forward channel to guide the air supplied from the air-conditioning unit to the conditioning target; and an exhaust channel to guide the air from the conditioning target to the second channel.

14. The image forming apparatus according to claim 13, wherein the first channel is connected to the forward channel, the second channel is connected to the exhaust channel, and the air-conditioning unit is removably attachable to a body of the image forming apparatus.

15. The image forming apparatus according to claim 1, further comprising a discharge sheet tray provided between the first and second external vents, wherein the discharge sheet tray serves as a shield to inhibit the air exhausted from the second external vent from entering the first external vent.

16. The image forming apparatus according to claim 15, wherein the discharge sheet tray and the second external vent are arranged such that the air exhausted from the second external vent is guided to sheets discharged onto the discharge sheet tray.

17. The air-conditioning unit according to claim 1, wherein the processor operates the circulating route or the external-air intake route based on the result of comparison between the temperature of air in the second channel and the external air temperature, wherein the circulating route is operated when the temperature of the air in the second channel is lower than the external air temperature, and wherein the external-air intake route is operated when the external temperature of the air is lower than the temperature of the air in the second channel.

* * * * *